US009850787B2

(12) United States Patent
Asahi et al.

(10) Patent No.: US 9,850,787 B2
(45) Date of Patent: Dec. 26, 2017

(54) VALVE OPENING/CLOSING TIMING CONTROL DEVICE

(71) Applicant: AISIN SEIKI KABUSHIKI KAISHA, Kariya-shi, Aichi (JP)

(72) Inventors: Takeo Asahi, Kariya (JP); Yuji Noguchi, Obu (JP); Kenji Ikeda, Gotenba (JP); Hiroyuki Hamasaki, Obu (JP); Yoshiaki Iguchi, Toyohashi (JP); Tomohiro Kajita, Anjo (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 57 days.

(21) Appl. No.: 15/034,387

(22) PCT Filed: Nov. 18, 2014

(86) PCT No.: PCT/JP2014/080422
§ 371 (c)(1),
(2) Date: May 4, 2016

(87) PCT Pub. No.: WO2015/079961
PCT Pub. Date: Jun. 4, 2015

(65) Prior Publication Data

US 2016/0290180 A1 Oct. 6, 2016

(30) Foreign Application Priority Data

Nov. 29, 2013 (JP) ..... 2013-248163

(51) Int. Cl.
*F01L 1/34* (2006.01)
*F01L 1/344* (2006.01)
(Continued)

(52) U.S. Cl.
CPC ..... *F01L 1/3442* (2013.01); *F01L 1/047* (2013.01); *F01L 9/021* (2013.01);
(Continued)

(58) Field of Classification Search
CPC ..... F01L 1/3442; F01L 1/047; F01L 9/021; F01L 2101/00; F01L 1/34423; F01L 2103/00
(Continued)

(56) References Cited

U.S. PATENT DOCUMENTS 8,915,221 B2 * 12/2014 Taylor ..... F01L 1/3442 123/90.17
2003/0037741 A1 2/2003 Kohrs
(Continued)

FOREIGN PATENT DOCUMENTS

DE 101 34 320 A1 1/2003
EP 2 025 430 A1 2/2009
(Continued)

OTHER PUBLICATIONS

International Search Report (PCT/ISA/210) dated Feb. 10, 2015, by the Japanese Patent Office as the International Searching Authority for International Application No. PCT/JP2014/080422.
(Continued)

*Primary Examiner* — Zelalem Eshete
(74) *Attorney, Agent, or Firm* — Buchanan Ingersoll & Rooney PC

(57) ABSTRACT

The valve opening/closing timing control device includes: the driving rotating body; the driven rotating body; an advancing chamber and a retarding chamber formed by partitioning a fluid pressure chamber between the driving and driven rotating bodies; and a phase control unit supplying pressurized fluid to the advancing or retarding chamber via an advancing channel or a retarding channel penetrating through the driven rotating body. In the driven rotating body, an outer circumferential member and an inner circumferential member are formed integrally/coaxially with each other. The advancing and retarding channel form a predetermined
(Continued)

angle. Between every pair of an advancing channel and a retarding channel, a groove portion is formed in one of an inner circumferential surface of the outer circumferential member and an outer circumferential surface of the inner circumferential member, and an elongated protruding portion is formed on the other, at a position that corresponds to the groove portion.

10 Claims, 10 Drawing Sheets

(51) Int. Cl.
*F01L 1/047* (2006.01)
*F01L 9/02* (2006.01)

(52) U.S. Cl.
CPC . *F01L 2001/34423* (2013.01); *F01L 2101/00* (2013.01); *F01L 2103/00* (2013.01)

(58) Field of Classification Search
USPC ..... 123/90.17
See application file for complete search history.

(56) References Cited

U.S. PATENT DOCUMENTS

| | | | |
|---|---|---|---|
| 2012/0132160 | A1 | 5/2012 | Malen et al. |
| 2012/0174884 | A1 | 7/2012 | Shinomiya |
| 2013/0247855 | A1 | 9/2013 | Adachi et al. |
| 2013/0269638 | A1 | 10/2013 | Adachi et al. |

FOREIGN PATENT DOCUMENTS

| | | | |
|---|---|---|---|
| JP | 2000-161028 | A | 6/2000 |
| JP | 2007125677 | A | 5/2007 |
| JP | 2009-39781 | A | 2/2009 |
| JP | 2012052500 | A | 3/2012 |
| WO | 2010/128976 | A1 | 11/2010 |
| WO | 2012111388 | A1 | 8/2012 |

OTHER PUBLICATIONS

Written Opinion (PCT/ISA/237) dated Feb. 10, 2015, by the Japanese Patent Office as the International Searching Authority for International Application No. PCT/JP2014/080422.

Office Action (Notification of Reasons for Refusal) dated Apr. 18, 2017, by the Japanese Patent Office in corresponding Japanese Patent Application No. 2013-248163, and an English translation of the Office Action. (8 pgs).

* cited by examiner

VALVE OPENING/CLOSING TIMING CONTROL DEVICE

TECHNICAL FIELD

The present invention relates to a valve opening/closing timing control device that includes: a driving rotating body that rotates in synchronization with a crankshaft of an internal combustion engine; and a driven rotating body that rotates in synchronization with a camshaft for opening/closing a valve of the internal combustion engine.

BACKGROUND ART

In order to reduce the weight of the driven rotating body while ensuring the strength thereof, Patent Document 1 discloses a valve opening/closing timing control device that includes a driven rotating body that is configured with: a cylindrical outer circumferential member that is made of a lightweight aluminum-based material, and that constitutes a part on the outer circumference side; and a cylindrical inner circumferential member that is made of an iron-based material having a higher strength than the aluminum-based material, and that constitutes a part on the inner circumference side, the outer circumferential member and the inner circumferential member being coaxially integrated into one piece.

In the driven rotating body included in this valve opening/closing timing control device: the outer circumferential member has a partitioning portion that is integrated therewith and that partitions a fluid pressure chamber into an advancing chamber and a retarding chamber; the inner circumferential member has a protruding portion that is integrated therewith and that protrudes outward in the radial direction; and the protruding portion is embedded in the outer circumferential member inside the partitioning portion, so that the outer circumferential member and the inner circumferential member are prevented from rotating relative to each other.

An advancing channel for supplying a pressurized fluid, which is in communication with the advancing chamber, and a retarding channel for supplying a pressurized fluid, which is in communication with the retarding chamber, are formed to penetrate through the driven rotating body in the radial direction thereof.

PRIOR ART DOCUMENTS

Patent Documents

Patent Document 1: JP 2000-161028A

DISCLOSURE OF THE INVENTION

Problem to be Solved by the Invention

Since the above-described conventional valve opening/closing timing control device includes the driven rotating body that is configured with the outer circumferential member and the inner circumferential member that are coaxially integrated into one piece, there is the possibility of a gap occurring between the inner circumferential surface of the outer circumferential member and the outer circumferential surface of the inner circumferential member.

In particular, when the material of the outer circumferential member and the material of the inner circumferential member are different from each other, there is a high possibility of such a gap occurring, due to the difference in the coefficient of thermal expansion of the materials.

Therefore, if the advancing channel and the retarding channel are formed in the radial direction in series so as to penetrate through the outer circumferential member and the inner circumferential member, there is the possibility of the pressurized fluid leaking to the advancing channel and the retarding channel via a gap that has occurred between the inner circumferential surface of the outer circumferential member and the outer circumferential surface of the inner circumferential member, and there is the risk of being unable to timely control the rotation phase of the driven rotating body relative to the driving rotating body.

The present invention has been made in view of the above-described situation, and aims to provide a valve opening/closing timing control device that makes it easier to timely control the rotation phase of the driven rotating body relative to the driving rotating body even if the advancing channel and the retarding channel are formed in the radial direction in series so as to penetrate through the outer circumferential member and the inner circumferential member.

Means for Solving Problem

A characteristic configuration of a valve opening/closing timing control device according to one aspect of the present invention lies in that the valve opening/closing timing control device includes: a driving rotating body that rotates in synchronization with a crankshaft of an internal combustion engine; a driven rotating body that is located on an inner circumference side of the driving rotating body coaxially with a rotational axis of the driving rotating body so as to be relatively rotatable, and that rotates in synchronization with a camshaft for opening/closing a valve of the internal combustion engine; a fluid pressure chamber that is formed between the driving rotating body and the driven rotating body; an advancing chamber and a retarding chamber that are formed by partitioning the fluid pressure chamber with a partitioning portion that is provided on an outer circumference side of the driven rotating body, and at least one advancing channel and at least one retarding channel that are formed to penetrate through the driven rotating body in a radial direction of the driven rotating body; and a phase control unit for controlling a rotation phase of the driven rotating body relative to the driving rotating body by supplying a pressurized fluid to the advancing chamber or the retarding chamber via the advancing channel or the retarding channel, and that the driven rotating body has: a cylindrical outer circumferential member that is provided with the partitioning portion; and a cylindrical inner circumferential member that is located on an inside of the outer circumferential member in the radial direction, and the outer circumferential member and the inner circumferential member are formed integrally with and coaxially with each other, the advancing channel and the retarding channel are located such that a predetermined angle is formed by a center line of the advancing channel in a longitudinal direction of the advancing channel and a center line of the retarding channel in a longitudinal direction of the retarding channel, and between every pair of an advancing channel and a retarding channel, a groove portion is formed in one of an inner circumferential surface of the outer circumferential member and an outer circumferential surface of the inner circumferential member, and an elongated protruding portion is formed on the other of the inner circumferential surface of the outer circumferential member and the outer circumferential surface of the inner circumferential member at a position that corresponds to the groove portion.

In the valve opening/closing timing control device having this configuration, the advancing channel and the retarding channel are located such that a predetermined angle is formed by a center line of the advancing channel in a longitudinal direction of the advancing channel and a center line of the retarding channel in a longitudinal direction of the retarding channel, and between every pair of an advancing channel and a retarding channel, a groove portion is formed in one of an inner circumferential surface of the outer circumferential member and an outer circumferential surface of the inner circumferential member, and an elongated protruding portion is formed on the other of the inner circumferential surface of the outer circumferential member and the outer circumferential surface of the inner circumferential member at a position that corresponds to the groove portion.

Thus, a labyrinth seal portion that has the function of reducing the leak pressure of the fluid using a groove portion and an elongated protruding portion that is embedded in the groove portion can be provided at the interface between the inner circumferential surface of the outer circumferential member and the outer circumferential surface of the inner circumferential member between every pair of an advancing channel and a retarding channel.

Therefore, in the valve opening/closing timing control device having this configuration, even if the advancing channel and the retarding channel are formed in the radial direction in series so as to penetrate through the outer circumferential member and the inner circumferential member, the labyrinth seal portions prevent the pressurized fluid from leaking from the advancing channel and the retarding channel via the interface between the outer circumferential member and the inner circumferential member, and it is easy to timely control the rotation phase of the driven rotating body relative to the driving rotating body.

Another characteristic configuration of one aspect of the present invention lies in that the advancing channel and the retarding channel are located at different positions along a rotation direction of the driven rotating body, and the groove portion and the elongated protruding portion are provided to extend in a direction along the rotational axis.

Note that the rotation direction means the direction of rotation about the rotational axis, along an imaginary plane that is orthogonal to the rotational axis.

With this configuration, while the labyrinth seal portion is provided at the interfaces of the advancing channel and the retarding channel, the elongated protruding portion is embedded in the groove portion that extends along the direction of the rotational axis, and thus the outer circumferential member and the inner circumferential member can be prevented from rotating relative to each other.

Another characteristic configuration of one aspect of the present invention lies in that the advancing channel and the retarding channel that are adjacent to each other are located at different positions along the rotational axis, and the groove portion and the elongated protruding portion are provided to extend along a rotation direction of the driven rotating body.

With this configuration, while the labyrinth seal portion is provided at the interfaces of the advancing channel and the retarding channel, the elongated protruding portion is embedded in the groove portion that extends along the rotation direction, and thus the relative displacement of the outer circumferential member and the inner circumferential member in the direction of the rotational axis can be prevented.

Another characteristic configuration of one aspect of the present invention lies in that the groove portion is formed in the outer circumferential surface of the inner circumferential member, and a protruding portion is formed on the outer circumferential surface of the inner circumferential member, the protruding portion making one end portion of the groove portion more protruding than a remaining portion, and an outer circumferential portion of the inner circumferential member is enveloped in the outer circumferential member using insert casting.

With this configuration, it is possible to form the elongated protruding portion, which is to be embedded in the groove portion that is formed in the outer circumferential surface of the inner circumferential member, on the inner circumferential surface of the outer circumferential member by enveloping the outer circumferential portion of the inner circumferential member in the outer circumferential member using insert casting.

Also, it is possible to embed the protruding portion formed on the outer circumferential surface of the inner circumferential member in the inner circumferential surface of the outer circumferential member by enveloping the outer circumferential portion of the inner circumferential member in the outer circumferential member using insert casting, and it is thus possible to prevent the relative displacement of the outer circumferential member and the inner circumferential member in the rotation direction and in the rotational axis direction.

Another characteristic configuration of one aspect of the present invention lies in that the groove portion is formed by forge-processing by which pressure is applied to the outer circumferential member or the inner circumferential member in a direction along the rotational axis.

With this configuration, it is possible to form the groove portion while increasing the strength of the outer circumferential member or the inner circumferential member by forge-processing.

Another characteristic configuration of one aspect of the present invention lies in that the advancing channel and the retarding channel penetrate through a bottom surface of the groove portion formed in the inner circumferential member.

With this configuration, it is possible to improve the machining efficiency by reducing the amount of machining on the inner circumferential member, performed to form the advancing channel and the retarding channel penetrating the driven rotating body.

Another characteristic configuration of a valve opening/closing timing control device according to one aspect of the present invention lies in that the valve opening/closing timing control device includes: a driving rotating body that rotates in synchronization with a crankshaft of an internal combustion engine; a driven rotating body that is located on an inner circumference side of the driving rotating body coaxially with a rotational axis of the driving rotating body so as to be relatively rotatable, and that rotates in synchronization with a camshaft for opening/closing a valve of the internal combustion engine; a fluid pressure chamber that is formed between the driving rotating body and the driven rotating body; an advancing chamber and a retarding chamber that are formed by partitioning the fluid pressure chamber with a partitioning portion that is provided on an outer circumference side of the driven rotating body, and at least one advancing channel and at least one retarding channel that are formed to penetrate through the driven rotating body in a radial direction of the driven rotating body; and a phase control unit for controlling a rotation phase of the driven rotating body relative to the driving rotating body by supplying a pressurized fluid to the advancing chamber or the retarding chamber via the advancing channel or the retarding channel, and that the driven rotating body has: a cylindrical outer circumferential member that is provided with the partitioning portion; and a cylindrical inner circumferential member that is located on an inside of the outer circumferential member in the radial direction, and the outer circumferential member and the inner circumferential member are formed integrally with and coaxially with each other, a columnar portion that has a height that allows a front end surface thereof to be exposed from an outer circumferential surface of the outer circumferential member is formed integrally with the inner circumferential member so as to extend from an outer circumferential surface of the inner circumferential member, an outer circumferential portion of the inner circumferential member is enveloped in the outer circumferential member using insert casting, and thus the outer circumferential member and the inner circumferential member are joined together, and the advancing channel and the retarding channel extend to a surface that is flush with the front end surface of the columnar portion, and penetrate through the inner circumferential member.

In the valve opening/closing timing control device having this configuration, a columnar portion that has a height that allows a front end surface thereof to be exposed from an outer circumferential surface of the outer circumferential member is formed integrally with the inner circumferential member so as to extend from an outer circumferential surface of the inner circumferential member, an outer circumferential portion of the inner circumferential member is enveloped in the outer circumferential member using insert casting, and thus the outer circumferential member and the inner circumferential member are joined together, and the advancing channel and the retarding channel extend to a surface that is flush with the front end surface of the columnar portion, and penetrate through the inner circumferential member.

Therefore, it is possible to form the advancing channel and the retarding channel such that the interface between the outer circumferential member and the inner circumferential member is apart from intermediate positions on the advancing channel and the retarding channel.

Therefore, in the valve opening/closing timing control device having this configuration, even if the advancing channel and the retarding channel are formed in the radial direction in series so as to penetrate through the outer circumferential member and the inner circumferential member, there is no risk of the pressurized fluid leaking from the advancing channel and the retarding channel via the interface between the outer circumferential member and the inner circumferential member, and it is easy to timely control the rotation phase of the driven rotating body relative to the driving rotating body.

Another characteristic configuration of a valve opening/closing timing control device according to one aspect of the present invention lies in that the valve opening/closing timing control device includes: a driving rotating body that rotates in synchronization with a crankshaft of an internal combustion engine; a driven rotating body that is located on an inner circumference side of the driving rotating body coaxially with a rotational axis of the driving rotating body so as to be relatively rotatable, and that rotates in synchronization with a camshaft for opening/closing a valve of the internal combustion engine; a fluid pressure chamber that is formed between the driving rotating body and the driven rotating body; an advancing chamber and a retarding chamber that are formed by partitioning the fluid pressure chamber with a partitioning portion that is provided on an outer circumference side of the driven rotating body, and at least one advancing channel and at least one retarding channel that are formed to penetrate through the driven rotating body in a radial direction of the driven rotating body; and a phase control unit for controlling a rotation phase of the driven rotating body relative to the driving rotating body by supplying a pressurized fluid to the advancing chamber or the retarding chamber via the advancing channel or the retarding channel, and that the driven rotating body has: a cylindrical outer circumferential member that is provided with the partitioning portion; and a cylindrical inner circumferential member that is located on an inside of the outer circumferential member in the radial direction, the outer circumferential member and the inner circumferential member are formed integrally with and coaxially with each other, a through hole that penetrates through the inner circumferential member in a radial direction of the driven rotating body is formed in the inner circumferential member, the outer circumferential member and the inner circumferential member are joined together by, using insert casting, enveloping an outer circumferential portion of the inner circumferential member in the outer circumferential member such that a portion of the outer circumferential member becomes embedded in the through hole, and the advancing channel and the retarding channel penetrate through the portion of the outer circumferential member that is filled in the through hole.

In the valve opening/closing timing control device having this configuration, a through hole that penetrates through the inner circumferential member in a radial direction of the driven rotating body is formed in the inner circumferential member, the outer circumferential member and the inner circumferential member are joined together by, using insert casting, enveloping an outer circumferential portion of the inner circumferential member in the outer circumferential member such that a portion of the outer circumferential member becomes embedded in the through hole, and the advancing channel and the retarding channel penetrate through the portion of the outer circumferential member that is filled in the through hole.

Therefore, it is possible to form the advancing channel and the retarding channel such that the interface between the outer circumferential member and the inner circumferential member is apart from intermediate positions on the advancing channel and the retarding channel.

Therefore, in the valve opening/closing timing control device having this configuration, even if the advancing channel and the retarding channel are formed in the radial direction in series so as to penetrate through the outer circumferential member and the inner circumferential member, there is no risk of the pressurized fluid leaking from the advancing channel and the retarding channel via the interface between the outer circumferential member and the inner circumferential member, and it is easy to timely control the rotation phase of the driven rotating body relative to the driving rotating body.

Another characteristic configuration of one aspect of the present invention lies in that the inner circumferential member is formed with an iron-based material.

With this configuration, it is easy to ensure the strength of the driven rotating body by using the inner circumferential member.

Another characteristic configuration of one aspect of the present invention lies in that the outer circumferential member is formed with a material that is lighter in weight than iron-based materials.

With this configuration, it is easy to reduce the weight of the driven rotating body by using the outer circumferential member.

BEST MODE FOR CARRYING OUT THE INVENTION

The following describes embodiments of the present invention with reference to the drawings.

First Embodiment

FIG. 1 to FIG. 4 show a valve opening/closing timing control device A according to one aspect of the present invention, which is to be installed to a gasoline engine (internal combustion engine) E for automobiles.

Figure 1:
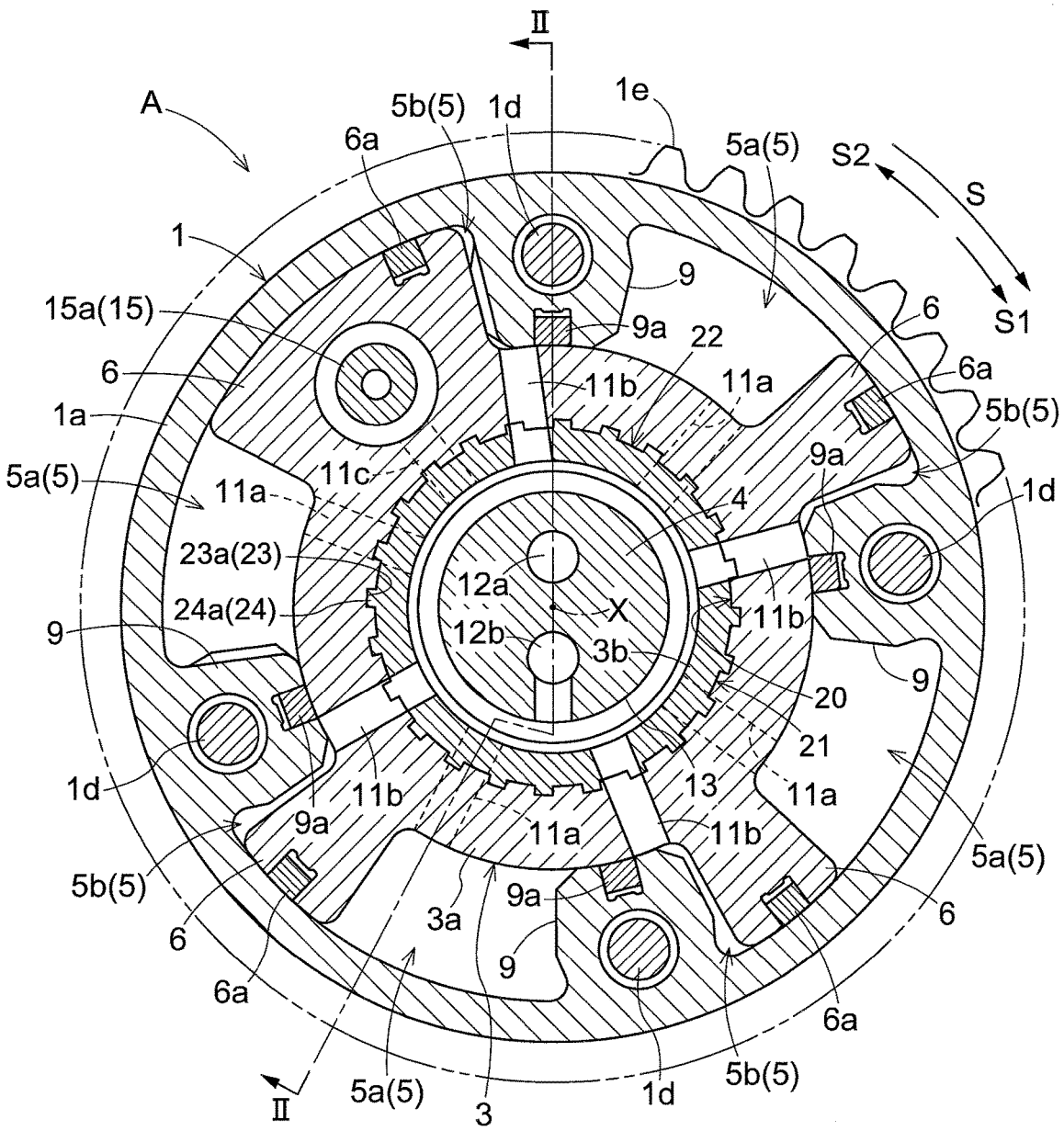
FIG. 1 is a front view showing an inside of a valve opening/closing timing control device according to a first embodiment.
Figure 2:
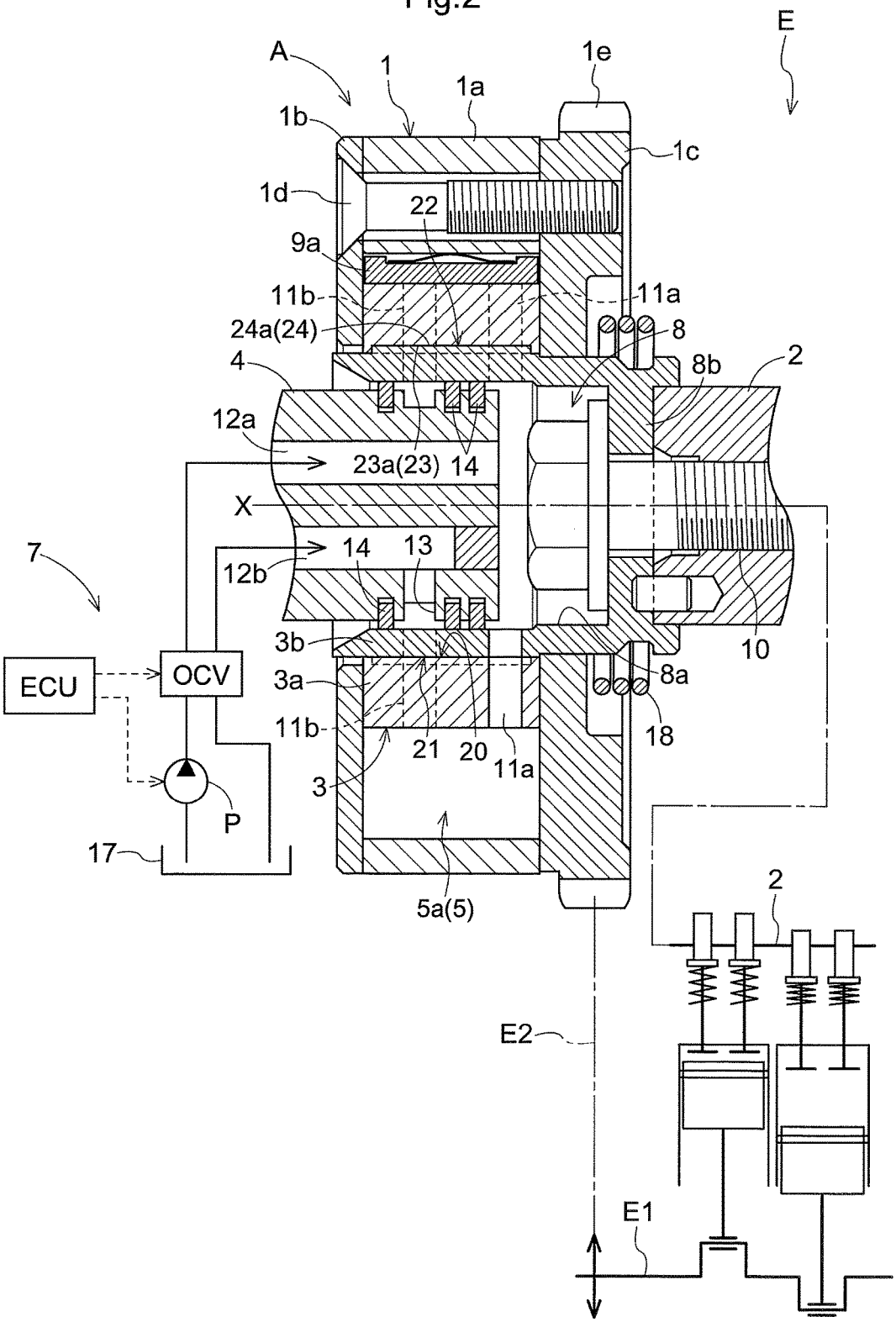
FIG. 2 is a cross-sectional view along a line II-II in FIG. 1 seen in a direction indicated by arrows.

As shown in FIG. 1 and FIG. 2, the valve opening/closing timing control device A includes: a housing 1 serving as a "driving rotating body" that rotates in synchronization with a crankshaft E1 of an engine E; an inner rotor 3 serving as a "driven rotating body" that is located on the inner circumference side of the housing 1 coaxially with a rotational axis X of the housing 1 so as to be relatively rotatable, and that rotates in synchronization with a camshaft 2 for opening/closing a valve of the engine E; a fixed shaft portion 4 by which the inner circumference side of the inner rotor 3 is supported so as to be rotatable about the rotational axis X; fluid pressure chambers 5 that are formed between the housing 1 and the inner rotor 3; advancing chambers 5*a* and retarding chambers 5*b* that are formed by partitioning the fluid pressure chambers 5 with partitioning portions 6 that are provided on the outer circumference side of the inner rotor 3 integrally therewith; and a phase control unit 7 that controls the rotation phase of the inner rotor 3 relative to the housing 1 by supplying hydraulic oil (engine oil) serving as a "pressurized fluid" to the advancing chambers 5*a* or the retarding chambers 5*b*.

The camshaft 2 is rotatably attached to a cylinder head (not shown in the drawings) of the engine E. The fixed shaft portion 4 is fixed to a static member such as a front cover of the engine E.

The housing 1 includes: an outer rotor 1*a* having a cylindrical outer circumferential shape; a front plate 1*b* that is located on the front side of the outer rotor 1*a;* and a rear plate 1*c* that is located on the rear side of the outer rotor 1*a*, which are fixed to each other with coupling bolts 1*d* and are integrated into one piece.

The outer rotor 1*a* and the front plate 1*b* are formed with an aluminum-based material such as an aluminum alloy that is lighter in weight than iron-based materials.

The rear plate 1*c* includes a sprocket 1*e* that is provided on the outer circumference side of the rear plate 1*c* integrally therewith, and is formed with an iron-based material such as steel.

A power transmission member E2 such as a timing chain or a timing belt is wound around the sprocket 1*e* and a sprocket that is attached to the crankshaft E1, and the housing 1 rotates in the direction indicated by an arrow S shown in FIG. 1 as the engine E is driven.

The inner rotor 3 is fixed to a tip portion of the camshaft 2 that is provided with a cam (not shown in the drawings) that controls opening/closing of an intake valve or an exhaust valve of the engine E.

The inner rotor 3 is driven to rotate in the direction indicated by the arrow S along with the rotation of the housing 1.

The inner rotor 3 is provided with a recessed portion 8 that has a cylindrical inner circumferential surface 8*a* that is coaxial with the rotational axis X. The inner rotor 3 and the camshaft 2 are fixed to each other and are integrated into one piece by screwing a bolt 10, which has been inserted into a bottom plate portion 8*b* of the recessed portion 8, into the camshaft 2 coaxially therewith.

A torsion coil spring 18 that biases the rotation phase of the inner rotor 3 relative to the housing 1 toward the advance side is attached so as to span the inner rotor 3 and the rear plate 1*c*.

A plurality of protruding portions 9 (four in the present embodiment) that protrude inward in the radial direction are formed on the inner circumference side of the outer rotor 1*a* integrally therewith, at positions that are separated from each other in the rotation direction.

Each protruding portion 9 is provided such that a protruding end portion thereof is slidable along the outer circumferential surface of the inner rotor 3 with a seal member 9*a* therebetween.

Four fluid pressure chambers 5 are formed between the protruding portions 9 that are adjacent to each other in the rotation direction, and between the outer rotor 1*a* and the inner rotor 3.

The coupling bolts 1*d* are respectively inserted through the protruding portions 9, by which the outer rotor 1*a*, the front plate 1*b*, and the rear plate 1*c* are fixed to each other and are integrated into one piece.

A plurality of partitioning portions 6 (four in the present embodiment) that protrude outward in the radial direction are formed on the outer circumference side of the inner rotor 3 integrally therewith, at positions that respectively face the fluid pressure chambers 5 and are separated from each other in the rotation direction.

Each partitioning portion 6 is provided such that a protruding end portion thereof is slidable along the inner circumferential surface of the outer rotor 1*a* with a seal member 6*a* therebetween.

Each fluid pressure chamber 5 is partitioned by the corresponding partitioning portion 6 into an advancing chamber 5*a* and a retarding chamber 5*b* that are adjacent to each other in the rotation direction.

In the inner rotor 3, advancing channels 11*a* that each have a circular cross section and are in communication with the advancing chambers 5*a*, and retarding channels 11*b* that each have a circular cross section and are in communication with the retarding chambers 5*b*, are formed to penetrate through the inner rotor 3 in the radial direction of rotation and to be in communication with the inner circumference side, specifically the recessed portion 8, of the inner rotor 3.

Hydraulic oil is supplied to or discharged from the advancing chambers 5*a* via the advancing channels 11*a*, and is supplied to or discharged from the retarding chambers 5*b* via the retarding channels 11*b*.

Figure 3:
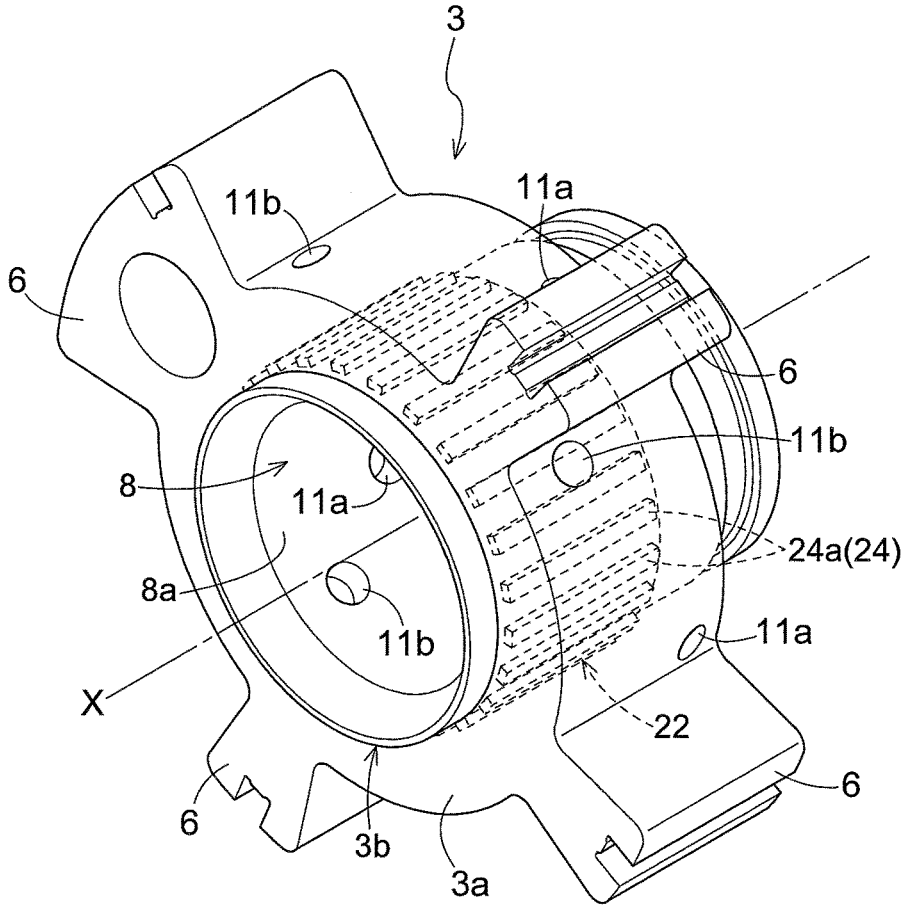
FIG. 3 is a perspective view of an inner rotor (a driven rotating body) according to the first embodiment.

As shown in FIG. 1 and FIG. 3, the advancing channels 11*a* and the retarding channels 11*b* are formed between the partitioning portions 6 that are adjacent to one another in the rotation direction, so as to be displaced from each other in the rotational axis X and so as to be out of phase with each other around the rotational axis X.

Each advancing channel 11*a* is formed between partitioning portions 6 that are adjacent to each other in the rotation direction, at a position closer to the partitioning portion 6 that is located on the side indicated by an advance direction S1 described below, and each retarding channel 11*b* is formed between partitioning portions 6 that are adjacent to each other in the rotation direction, at a position closer to the partitioning portion 6 that is located on the side indicated by a retard direction S2 described below.

Therefore, when seen in the direction along the rotational axis X, an advancing channel 11*a* and a retarding channel 11*b* that are adjacent to each other are located at different positions along the rotation direction of the inner rotor 3 such that a predetermined angle is formed by the center line of the advancing channel 11*a* in the longitudinal direction of the advancing channel 11*a* and the center line of the retarding channel 11*b* in the longitudinal direction of the retarding channel 11*b*.

Also, as shown in FIG. 2 and FIG. 3, the advancing channels 11*a* are in communication with the recessed portion 8 at positions that are on the rear plate 1*c* side and that face a space between the fixed shaft portion 4 and the bottom plate portion 8*b*, and the retarding channels 11*b* are in communication with the recessed portion 8 at positions that are closer to the front plate 1*b* than the advancing channels 11*a* are and that face the outer circumferential surface of the fixed shaft portion 4.

Thus, an advancing channel 11*a* and a retarding channel 11*b* that are adjacent to each other are located at different positions along the rotational axis X when seen in the direction that is orthogonal to the rotational axis X.

The fixed shaft portion 4 has: an advance-side supply channel 12*a* serving as a fluid channel that can be in communication with the advancing channels 11*a;* and a retard-side supply channel 12*b* serving as a fluid channel that can be in communication with the retarding channels 11*b*.

The advance-side supply channel 12*a* is in communication with the space between the fixed shaft portion 4 and the bottom plate portion 8*b* from one end side of the fixed shaft portion 4 in the axial direction thereof, and the retard-side supply channel 12*b* is in communication with a ring-shaped circumferential groove 13 that is formed in the outer circumferential surface of the fixed shaft portion 4.

Seal rings 14 that fill the gap between the outer circumferential surface of the fixed shaft portion 4 and the inner circumferential surface 8*a* of the recessed portion 8 are attached to both sides of the ring-shaped circumferential groove 13 and one end side of the fixed shaft portion 4 in the axial direction.

A lock mechanism 15 that can switch to a locked state in which the lock mechanism 15 restrains the rotation phase of the inner rotor 3 relative to the housing 1 at the maximum retard position, and to an unlocked state in which the lock mechanism 15 releases the restraint, is provided to span the inner rotor 3 and the housing 1.

The lock mechanism 15 is configured by attaching a lock member 15*a* to one of the partitioning portions 6 of the inner rotor 3, the lock member 15*a* having a tip portion that can protrude and retract in the direction along the rotational axis X relative to a recessed portion (not shown in the drawings) formed in the rear plate 1*c*.

The lock mechanism 15 switches to the locked state upon the tip portion of the lock member 15*a* becoming embedded in the recessed portion due to the biasing force of a biasing member (not shown in the drawings) such as a compression spring, and switches to the unlocked state upon the tip portion exiting the recessed portion toward the inner rotor 3 side, moving against the biasing force of the biasing member, due to the pressure of the hydraulic oil supplied via a lock oil channel 11*c* that is in communication with the ring-shaped circumferential groove 13.

The phase control unit 7 includes: an oil pump P that sucks/discharges hydraulic oil within an oil pan 17; a fluid control valve OCV that supplies/discharges hydraulic oil to/from the advance-side supply channel 12*a* and the retard-side supply channel 12*b*, and interrupts the supply/discharge of hydraulic oil; and an electronic control unit ECU that controls the actions of the fluid control valve OCV.

The rotation phase of the inner rotor 3 relative to the housing 1 is displaced in the advance direction (the direction of increasing the capacities of the advancing chambers 5*a*) indicated by the arrow S1, or in the retard direction (the direction of increasing the capacities of the retarding chambers 5*b*) indicated by the arrow S2 by a hydraulic oil supplying/discharging operation of the phase control unit 7, and the rotation phase is maintained at a given phase by a hydraulic oil supply/discharge interrupting operation.

The lock mechanism 15 switches from the locked state to the unlocked state upon hydraulic oil being supplied via the lock oil channel 11*c* in response to an operation to supply hydraulic oil to the advancing chambers 5*a*.

Figure 4:
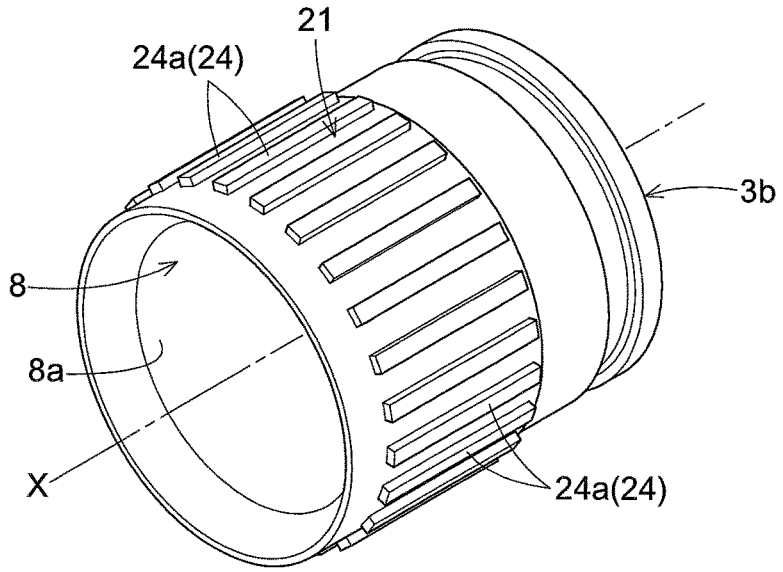
FIG. 4 is a perspective view of an inner circumferential member according to the first embodiment.

As shown in FIG. 3 and FIG. 4 as well, the inner rotor 3 has: a cylindrical outer circumferential member 3*a* that is integrated with the partitioning portions 6 provided on the outer circumference side thereof; and a cylindrical inner circumferential member 3*b* that is located on an inside of the outer circumferential member 3*a* in the radial direction, and the outer circumferential member 3*a* and the inner circumferential member 3*b* are formed integrally with each other, and coaxially with the rotational axis X.

The inner circumferential member 3*b* is configured with a high-strength sintered or forged article that has been formed with an iron-based material, for example. The outer circumferential member 3*a* is formed with a material that is lighter in weight than the iron-based material with which the inner circumferential member 3*b* is formed, specifically an aluminum-based material such as an aluminum alloy, for example. The outer circumferential portion of the inner circumferential member 3*b* is enveloped in the outer circumferential member 3*a* using insert casting.

The outer circumferential member 3*a* is provided with a cylindrical inner circumferential surface 20, and the inner circumferential member 3*b* is provided with a cylindrical outer circumferential surface 21 that is fitted into the inner circumferential surface 20.

The recessed portion 8 is formed in the inner circumferential member 3*b*, and the inner circumferential member 3*b* and the camshaft 2 are connected and fixed to each other with the bolt 10 and are integrated into one piece.

In the inner rotor 3, the outer circumferential portion of the inner circumferential member 3*b* is enveloped with the aluminum-based material with which the outer circumferential member 3*a* is configured, using insert casting, and thus the inner circumferential surface 20 of the outer circumferential member 3*a* and the outer circumferential surface 21 of the inner circumferential member 3*b* are coaxially joined to each other in the state of being prevented from rotating.

Along a joint 22 between the inner circumferential surface 20 of the outer circumferential member 3*a* and the outer circumferential surface 21 of the inner circumferential member 3*b* between every pair of an advancing channel 11*a* and a retarding channel 11*b*, groove portions 23 are formed in one of the inner circumferential surface 20 of the outer circumferential member 3*a* and the outer circumferential surface 21 of the inner circumferential member 3*b*, and elongated protruding portions 24 are formed on the other of the inner circumferential surface 20 of the outer circumferential member 3*a* and the outer circumferential surface 21 of the inner circumferential member 3*b* at positions corresponding to the groove portions 23.

In other words, the groove portions 23 and the elongated protruding portions 24 that engage with each other in the radial direction of rotation are dispersed to the inner circumferential surface 20 of the outer circumferential member 3*a* and the outer circumferential surface 21 of the inner circumferential member 3*b*, and are located at positions between every adjacent pair of an advancing channel 11*a* and a retarding channel 11*b*.

Specifically, a plurality of pairs of: an axial direction groove portion 23*a* (23) that is formed in the inner circumferential surface 20 of the outer circumferential member 3*a;* and an axial direction elongated protruding portion 24*a* (24) that is formed in the outer circumferential surface 21 of the inner circumferential member 3*b* by forging or sinter molding so as to engage with the axial direction groove portion 23*a*, are provided at equal intervals in the rotation direction so as to extend along the rotational axis X, which intersects the rotation direction.

The plurality of axial direction groove portions 23*a* are formed in the inner circumferential surface 20 of the outer circumferential member 3*a* by, using insert casting, enveloping the outer circumferential portion of the inner circumferential member 3*b*, on which the axial direction elongated protruding portions 24*a* are formed, with the aluminum-based material with which the outer circumferential member 3*a* is configured.

At least one pair of an axial direction groove portion 23*a* and an axial direction elongated protruding portion 24*a* that engages with the axial direction groove portion 23*a* are located between every pair of an advancing channel 11*a* and a retarding channel 11*b* that are adjacent to each other in the rotation direction when seen in the direction along the rotational axis X, and the axial direction groove portion 23*a* and the axial direction elongated protruding portion 24*a* are separated from their corresponding advancing channel 11*a* and retarding channel 11*b*, and thus a labyrinth seal portion is provided.

The axial direction groove portions 23*a* and the axial direction elongated protruding portions 24*a* are formed at intermediate positions between the front plate 1*b* and the rear plate 1*c* so as to have a rectangular cross section, and are sized so as not to become embedded in the partitioning portions 6.

Therefore, it is possible to set the thickness of the partitioning portions 6 in the rotation direction to be small and the length of the fluid pressure chambers 5 in the rotation direction to be long, and it is easy to secure a large angular range within which the relative phase can be changed.

The relative movement of the outer circumferential member 3*a* and the inner circumferential member 3*b* in the rotation direction and in the direction along the rotational axis X is prevented by the axial direction groove portions 23*a* and the axial direction elongated protruding portions 24*a* engaging with each other.

Second Embodiment

Figure 5:
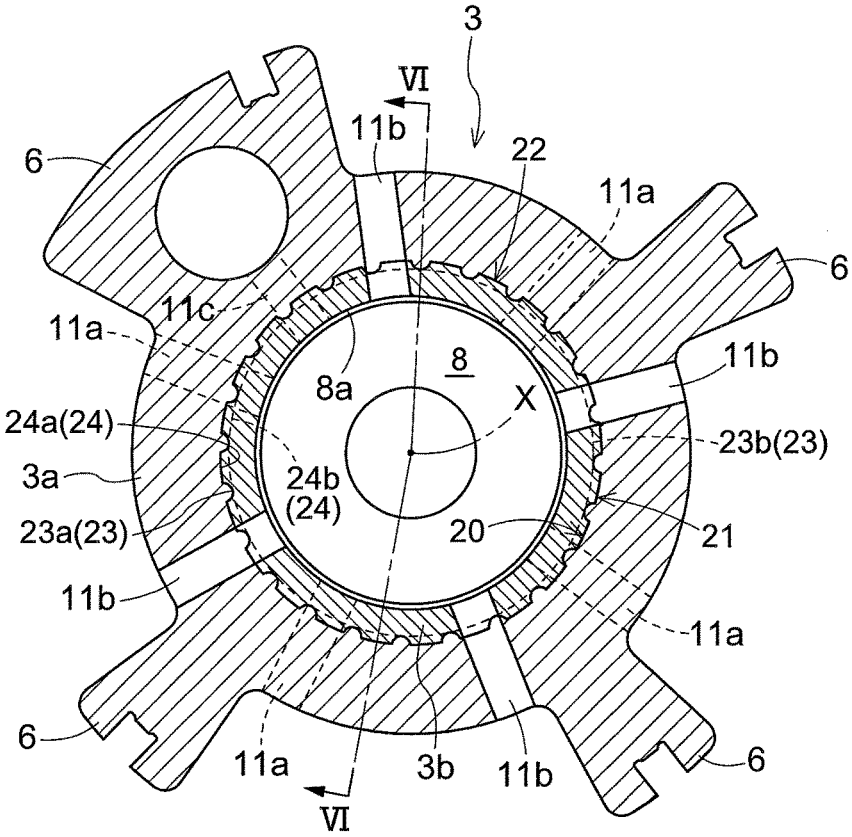
FIG. 5 is a lateral cross-sectional view of an inner rotor according to a second embodiment.
Figure 6:
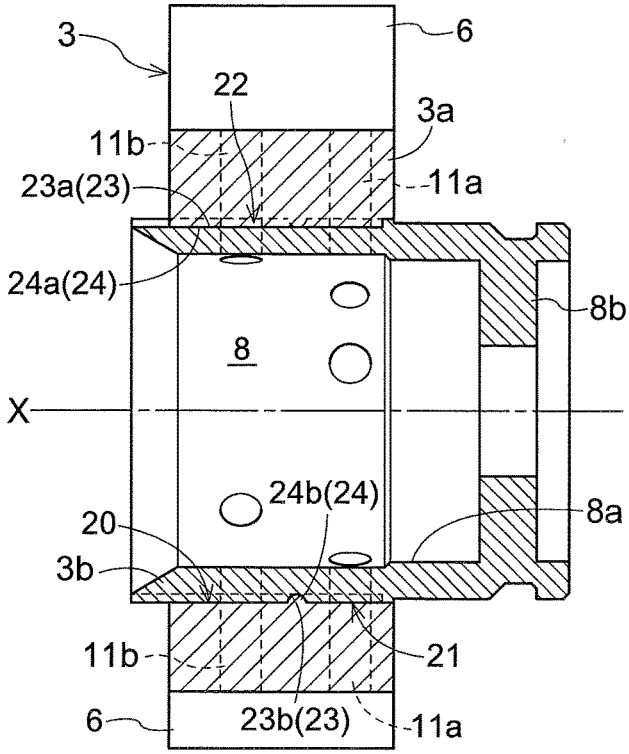
FIG. 6 is a cross-sectional view along a line VI-VI in FIG. 5 seen in a direction indicated by arrows.
Figure 7:
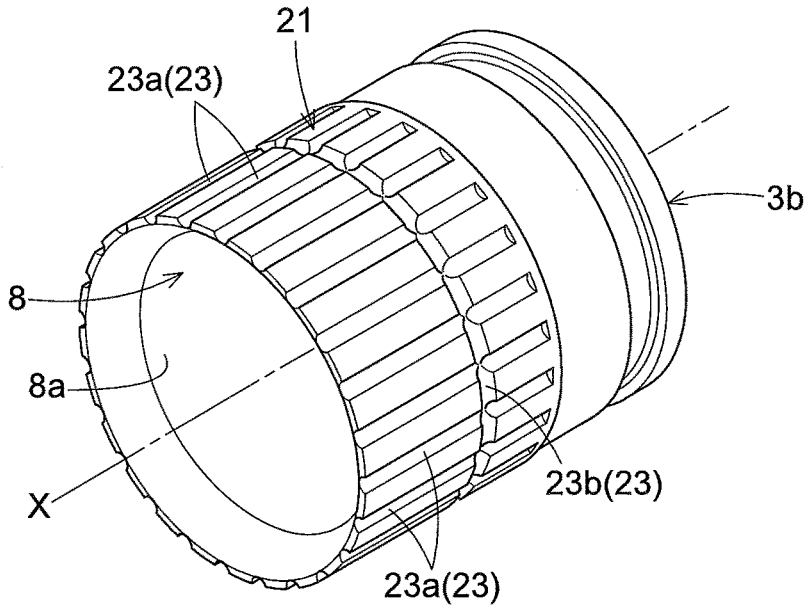
FIG. 7 is a perspective view of an inner circumferential member according to the second embodiment.

FIG. 5 to FIG. 7 show another embodiment of the present invention.

The present embodiment is different from the first embodiment in the configuration of the joint 22 between the inner circumferential surface 20 of the outer circumferential member 3*a* and the outer circumferential surface 21 of the inner circumferential member 3*b*.

Specifically, the joint 22 is provided with a plurality of pairs of a groove portion 23, which is formed in the outer circumferential surface 21 of the inner circumferential member 3*b* by using forging, sinter molding, or cutting, and an elongated protruding portion 24, which is formed in the inner circumferential surface 20 of the outer circumferential member 3*a* so as to engage with the groove portion 23.

The pairs of a groove portion 23 and an elongated protruding portion 24 that engages with the groove portion 23 include a plurality of pairs of an axial direction groove portion 23*a* (23), which extends in the direction along the rotational axis X, and an axial direction elongated protruding portion 24*a* (24), which engages with the axial direction groove portion 23*a*, and one pair of a circumferential direction groove portion 23*b* (23) and a circumferential direction elongated protruding portion 24*b* (24). The circumferential direction elongated protruding portions 24*b* (24) sequentially extend along the rotation direction so as to have a ring shape, and sequentially engage with the circumferential direction groove portions 23*b* (23).

As shown in FIG. 5, the plurality of pairs of an axial direction groove portion 23*a* and an axial direction elongated protruding portion 24*a* that engages with the axial direction groove portion 23*a*, are located at equal intervals in the rotation direction.

At least one pair of an axial direction groove portion 23*a* and an axial direction elongated protruding portion 24*a* are located between every pair of an advancing channel 11*a* and a retarding channel 11*b* that are adjacent to each other in the rotation direction when seen in the direction along the rotational axis X, and the axial direction groove portion 23*a* and the axial direction elongated protruding portion 24*a* are separated from their corresponding advancing channel 11*a* and retarding channel 11*b*, and thus a labyrinth seal portion is provided.

One end of each axial direction groove portion 23*a* is located at an intermediate position between the front plate 1*b* and the rear plate 1*c*, and the other end is provided to open in the end surface on the front plate 1*b* side.

The circumferential direction groove portions 23*b* and the circumferential direction elongated protruding portions 24*b* that engage with the circumferential direction groove portions 23*b* are provided at positions between a pair of an advancing channel 11*a* and a retarding channel 11*b* that are adjacent to each other in the rotational axis X, and the circumferential direction groove portions 23*b* and the circumferential direction elongated protruding portions 24*b* are located so as to intersect axial direction groove portions 23*a* and axial direction elongated protruding portions 24*a* at a right angle, so as to form a ring shape, and so as to be separated from their corresponding advancing channel 11*a* and retarding channel 11*b*.

The relative movement of the outer circumferential member 3*a* and the inner circumferential member 3*b* in the direction along the rotational axis X is prevented by the circumferential direction groove portions 23*b* and the circumferential direction elongated protruding portions 24*b* engaging with each other.

The axial direction elongated protruding portions 24*a* and the circumferential direction elongated protruding portions 24*b* are formed in the inner circumferential surface 20 of the outer circumferential member 3*a* by, using insert casting, enveloping the outer circumferential portion of the inner circumferential member 3*b*, in which the groove portions 23*a* and 23*b* are formed, with the aluminum-based material with which the outer circumferential member 3*a* is configured.

Thus, a ring-shaped labyrinth seal portion configured with the circumferential direction groove portions 23*b* and the circumferential direction elongated protruding portions 24*b* engaging with each other is formed in addition to the labyrinth seal portion configured with the axial direction groove portions 23*a* and the axial direction elongated protruding portions 24*a* engaging with each other.

All the pairs of an axial direction groove portion 23*a* and an axial direction elongated protruding portion 24*a* that engages with the axial direction groove portion 23*a* may be omitted, and only the pairs of a circumferential direction groove portion 23*b* and a circumferential direction elongated protruding portion 24*b* that engages with the circumferential direction groove portion 23*b* may be provided.

The other configurations are the same as those in the first embodiment.

Third Embodiment

Figure 8:
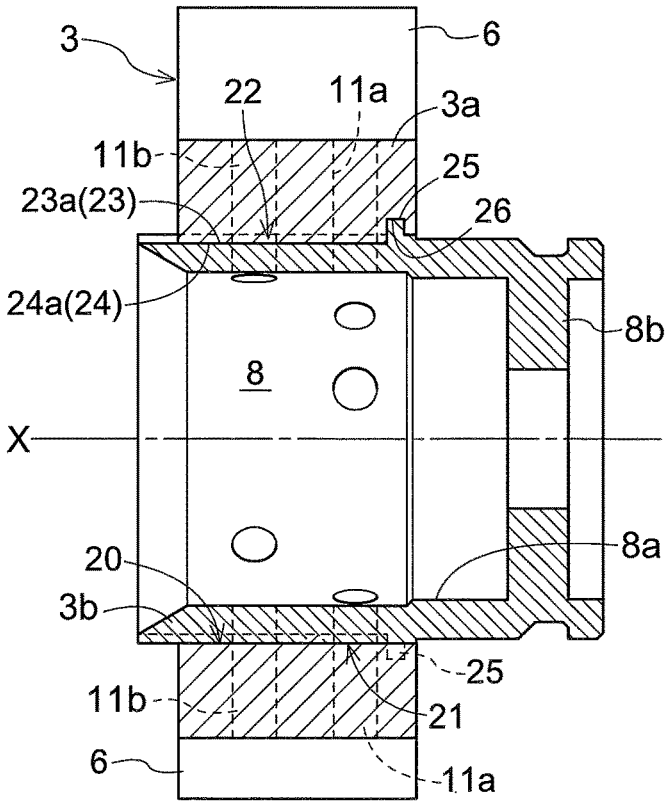
FIG. 8 is a vertical cross-sectional view of an inner rotor according to a third embodiment.
Figure 9:
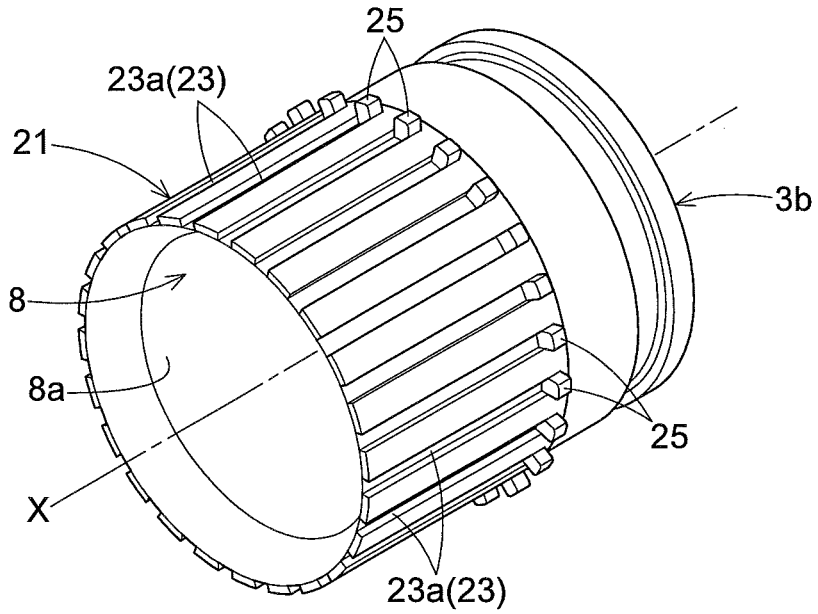
FIG. 9 is a perspective view of an inner circumferential member according to the third embodiment.

FIG. 8 and FIG. 9 show another embodiment of the present invention.

The present embodiment is different from the first embodiment in the configuration of the joint 22 between the inner circumferential surface 20 of the outer circumferential member 3*a* and the outer circumferential surface 21 of the inner circumferential member 3*b*.

Specifically, the joint 22 is provided with a plurality of pairs of an axial direction groove portion 23*a* (23), which is formed in the outer circumferential surface 21 of the inner circumferential member 3*b* by forge-processing, and an axial direction elongated protruding portion 24*a* (24), which is formed on the inner circumferential surface 20 of the outer circumferential member 3*a* so as to engage with the axial direction groove portion 23*a*, arranged at equal intervals in the rotation direction.

At least one pair of an axial direction groove portion 23*a* and an axial direction elongated protruding portion 24*a* are located between every pair of an advancing channel 11*a* and a retarding channel 11*b* that are adjacent to each other in the rotation direction when seen in the direction along the rotational axis X, and the axial direction groove portion 23*a* and the axial direction elongated protruding portion 24*a* are separated from their corresponding advancing channel 11*a* and retarding channel 11*b*, and thus a labyrinth seal portion is provided.

Each axial direction groove portion 23*a* is formed by forge-processing by which pressure is applied to the outer circumferential surface 21 of the inner circumferential member 3*b* in the direction along the rotational axis X.

Also, protruding portions 25, which each make one end portion of the axial direction groove portions 23*a* more protruding than the remaining portion, are formed on the outer circumferential surface 21 of the inner circumferential member 3*b*, using a pad generated by forge-processing performed on the axial direction groove portions 23*a*.

One end of each axial direction groove portion 23*a* is located at an intermediate position between the front plate 1*b* and the rear plate 1*c*, and the other end is provided to open in the end surface on the front plate 1*b* side.

The axial direction elongated protruding portions 24*a* that engage with the axial direction groove portions 23*a* and recessed portions 26 that engage with the protruding portions 25 are formed in the inner circumferential surface 20 of the outer circumferential member 3*a* by, using insert casting, enveloping the outer circumferential portion of the inner circumferential member 3*b*, in which the axial direction groove portions 23*a* and the protruding portions 25 are formed, with the aluminum-based material with which the outer circumferential member 3*a* is configured.

The relative movement of the outer circumferential member 3*a* and the inner circumferential member 3*b* in the direction along the rotational axis X is prevented by the protruding portions 25 and the recessed portions 26 engaging with each other.

The other configurations are the same as those in the first embodiment.

Fourth Embodiment

Figure 10:
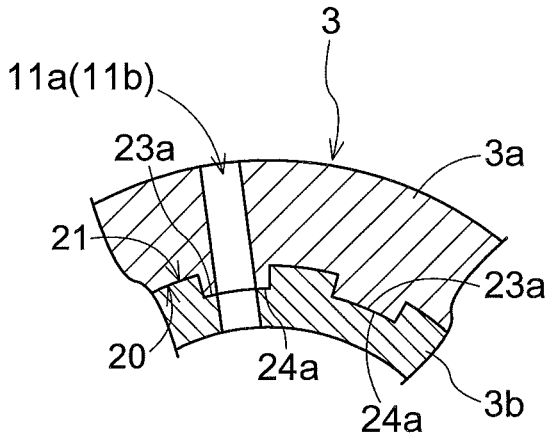
FIG. 10 is a lateral cross-sectional view showing a main portion of an inner rotor according to a fourth embodiment.

FIG. 10 shows a modification of the first or the third embodiment of the present invention.

In the present embodiment, the axial direction groove portions 23*a* are formed in the outer circumferential surface 21 of the inner circumferential member 3*b*, and the axial direction elongated protruding portions 24*a* that engage with the axial direction groove portions 23*a* are formed on the inner circumferential surface 20 of the outer circumferential member 3*a*.

The advancing channels 11*a* and the retarding channels 11*b* are formed to penetrate through the bottom surfaces of the axial direction groove portions 23*a*.

The other configurations are the same as those in the first or the third embodiment.

Fifth Embodiment

Figure 11:
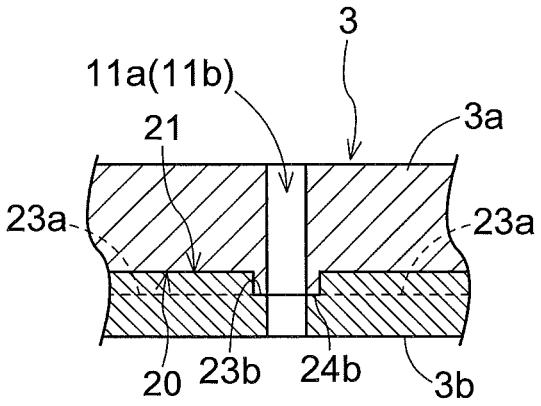
FIG. 11 is a lateral cross-sectional view showing a main portion of an inner rotor according to a fifth embodiment.

FIG. 11 shows a modification of the second embodiment of the present invention.

In the present embodiment, the circumferential direction groove portions 23*b* are formed in the outer circumferential surface 21 of the inner circumferential member 3*b*, and the circumferential direction elongated protruding portions 24*b* that engage with the circumferential direction groove portions 23*b* are formed on the inner circumferential surface 20 of the outer circumferential member 3*a*.

The advancing channels 11*a* and the retarding channels 11*b* are formed to penetrate through the bottom surfaces of the circumferential direction groove portions 23*b*.

The other configurations are the same as those in the second embodiment.

Sixth Embodiment

Figure 12:
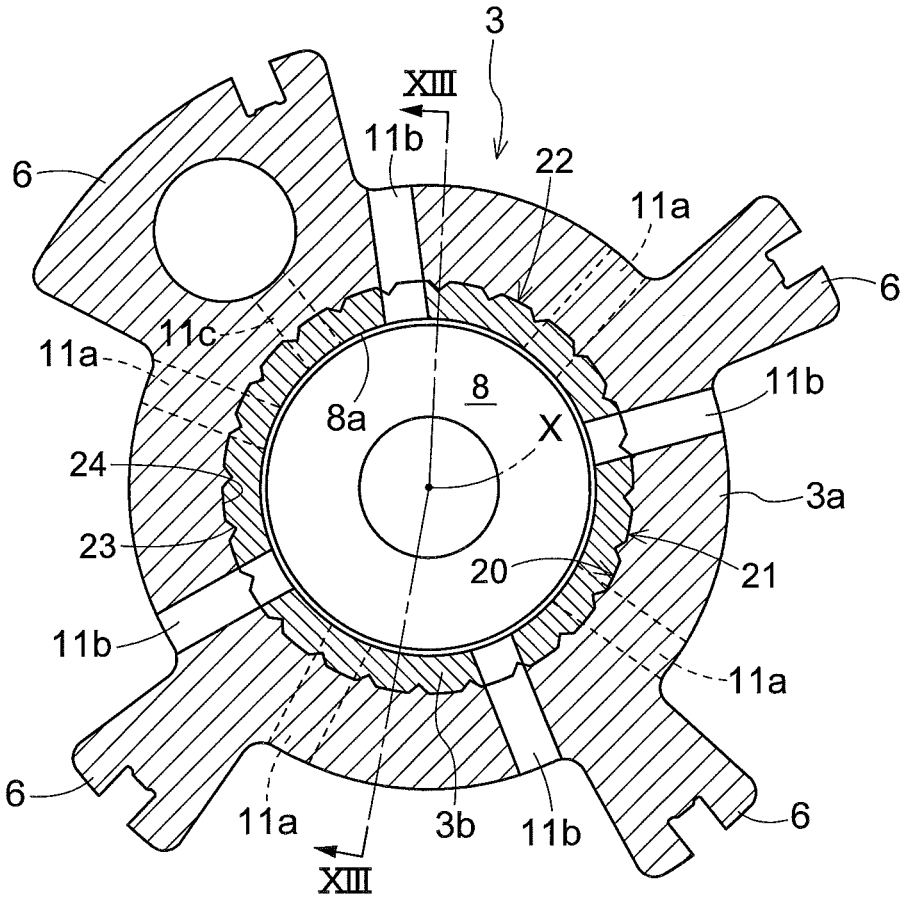
FIG. 12 is a lateral cross-sectional view of an inner rotor according to a sixth embodiment.
Figure 13:
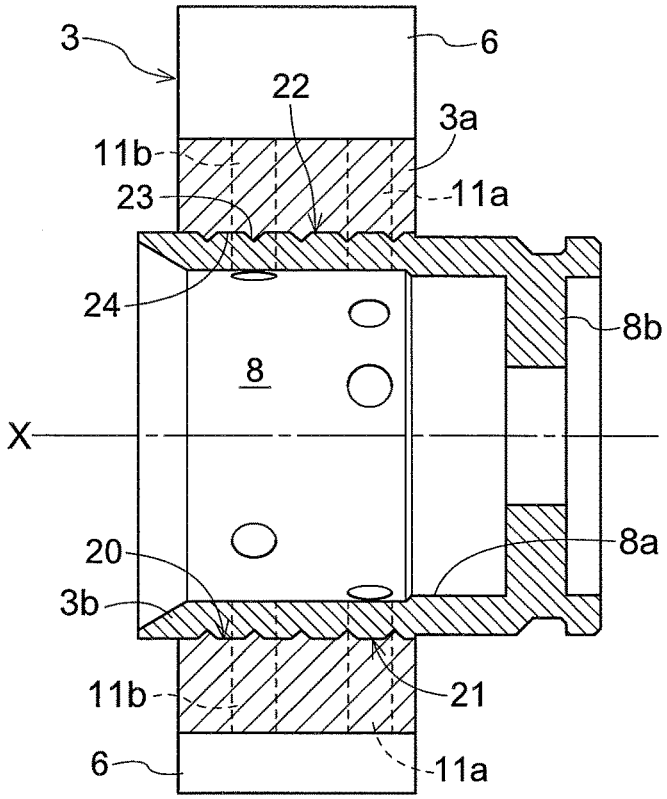
FIG. 13 is a cross-sectional view along a line XIII-XIII in FIG. 12 seen in a direction indicated by arrows.
Figure 14:
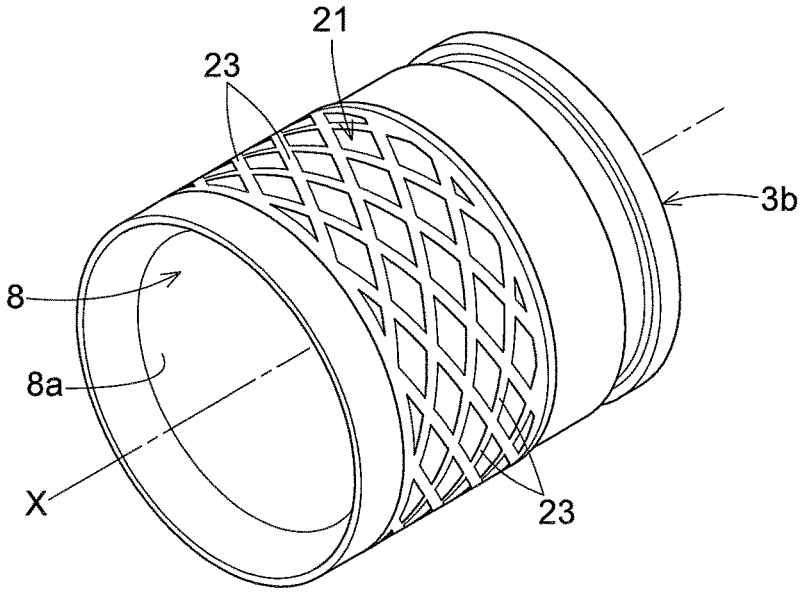
FIG. 14 is a perspective view of an inner circumferential member according to the sixth embodiment.

FIG. 12 to FIG. 14 show another embodiment of the present invention.

In the present embodiment, the joint 22 between the inner circumferential surface 20 of the outer circumferential member 3*a* and the outer circumferential surface 21 of the inner circumferential member 3*b* is provided with: the groove portions 23 that are arranged in a netted shape in the outer circumferential surface 21 of the inner circumferential member 3*b* by using knurling processing; and the elongated protruding portions 24 that are formed on the inner circumferential surface 20 of the outer circumferential member 3*a* so as to engage with the groove portions 23.

The groove portions 23 are arranged in a netted shape by using rolling processing, and the elongated protruding portions 24 that engage with the groove portions 23 are arranged in a netted shape in the inner circumferential surface 20 of the outer circumferential member 3*a* by, using insert casting, enveloping the outer circumferential portion of the inner circumferential member 3*b*, in which the groove portions 23 are formed, with the aluminum-based material with which the outer circumferential member 3*a* is configured.

The relative movement of the outer circumferential member 3*a* and the inner circumferential member 3*b* in the rotation direction and in the direction along the rotational axis X is prevented by the groove portions 23 and the elongated protruding portions 24 arranged in a netted shape, engaging with each other.

At least one pair of a groove portion 23 and an elongated protruding portion 24 that engages with the groove portion 23 are located between every pair of an advancing channel 11*a* and a retarding channel 11*b* that are adjacent to each other in the rotation direction when seen in the direction along the rotational axis X, and the groove portion 23 and the elongated protruding portion 24 extend in the direction that intersects the rotation direction and the direction along the rotation direction so as to be separated from their corresponding advancing channel 11*a* and retarding channel 11*b*, and thus a labyrinth seal portion is arranged in a netted shape.

The other configurations are the same as those in the first embodiment.

Seventh Embodiment

Figure 15:
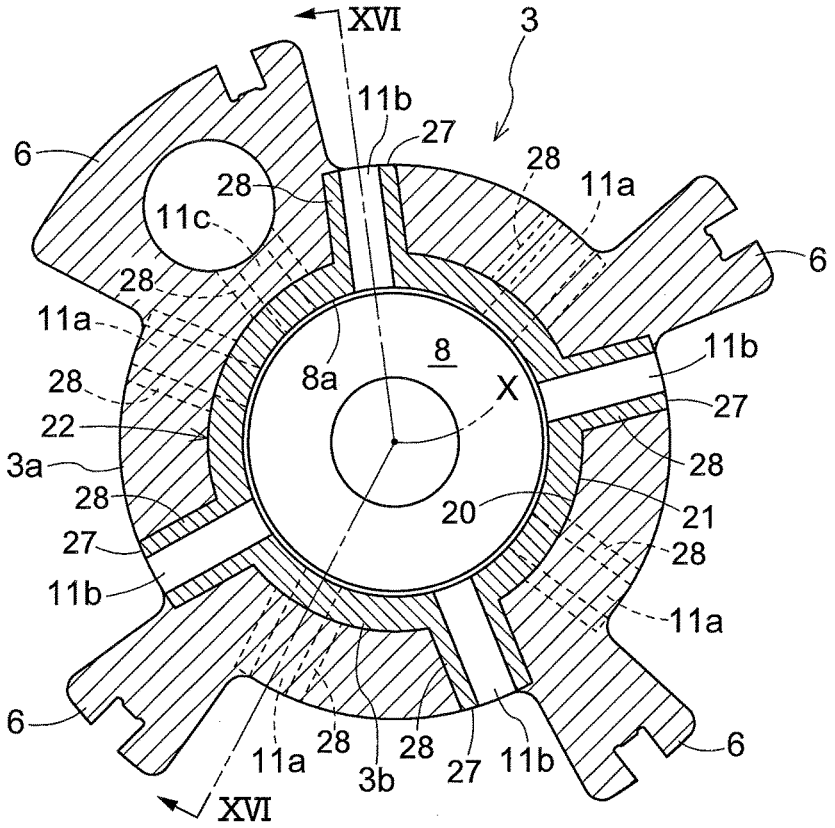
FIG. 15 is a lateral cross-sectional view of an inner rotor according to a seventh embodiment.
Figure 16:
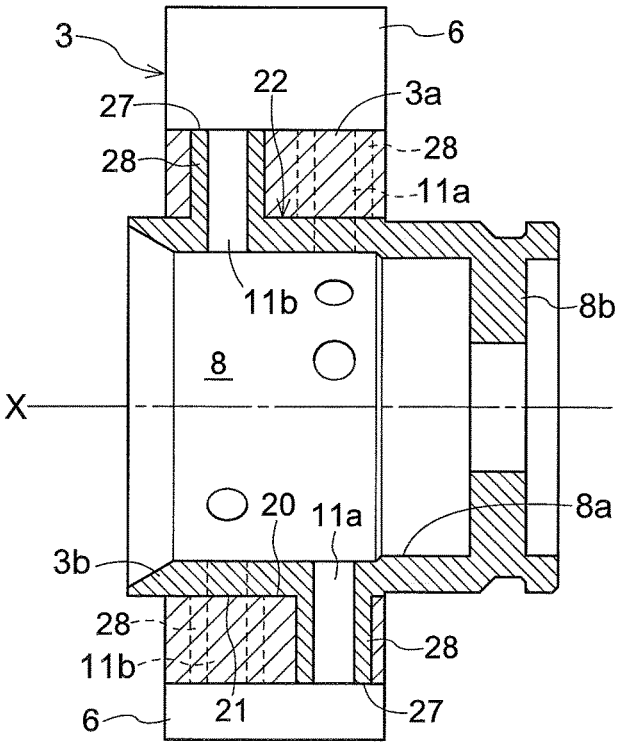
FIG. 16 is a cross-sectional view along a line XVI-XVI in FIG. 15 seen in a direction indicated by arrows.

FIG. 15 and FIG. 16 show another embodiment of the present invention.

In the present embodiment, columnar portions 28 that have a height that allows their respective front end surfaces 27 to be exposed from, and to be flush with, the outer circumferential surface 21 of the outer circumferential member 3*a* are formed integrally with the inner circumferential member 3*b* so as to extend from the outer circumferential surface 21 of the inner circumferential member 3*b*.

The inner rotor 3 is configured by, using insert casting, enveloping the outer circumferential portion of the inner circumferential member 3*b* with the aluminum-based material with which the outer circumferential member 3*a* is formed, and thus joining the outer circumferential member 3*a* and the inner circumferential member 3*b* in the state of being prevented from rotating, such that the respective front end surfaces 27 of the columnar portions 28 face the outer circumferential surface of the outer circumferential member 3*a*.

Consequently, the columnar portions 28 are embedded in the outer circumferential member 3*a*, and thus the relative movement of the outer circumferential member 3*a* and the inner circumferential member 3*b* in the rotation direction and in the direction along the rotational axis X is prevented.

All of the advancing channels 11*a* and all of the retarding channels 11*b* extend to the surface that is the same as the front end surfaces 27 of the columnar portions 28, and penetrate through the inner circumferential member 3*b*.

The other configurations are the same as those in the first embodiment.

Eighth Embodiment

Figure 17:
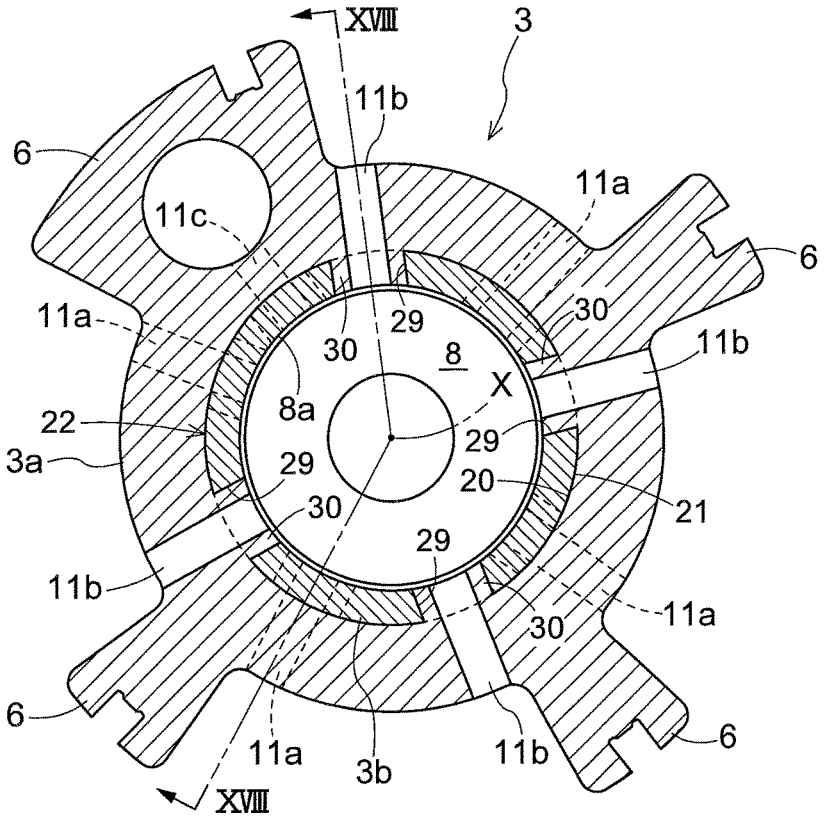
FIG. 17 is a lateral cross-sectional view of an inner rotor according to an eighth embodiment.
Figure 18:
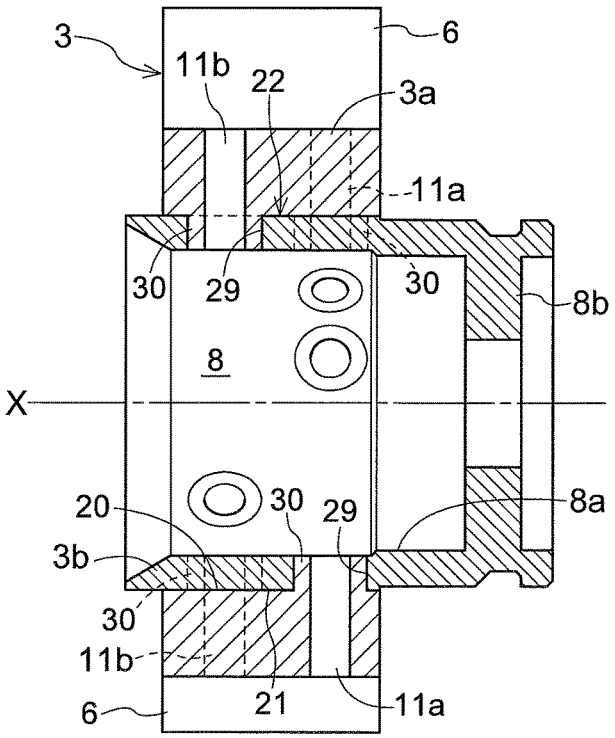
FIG. 18 is a cross-sectional view along a line XVIII-XVIII in FIG. 17 seen in a direction indicated by arrows.

FIG. 17 and FIG. 18 show another embodiment of the present invention.

In the present embodiment, through holes 29 that each have a circular cross section and penetrate through the inner circumferential member 3*b* in the radial direction of rotation are formed in the inner circumferential member 3*b*.

The inner rotor 3 is configured by, using insert casting, enveloping the outer circumferential portion of the inner circumferential member 3*b*, in which the through holes 29 are formed, with the aluminum-based material with which the outer circumferential member 3*a* is formed, and thus joining the outer circumferential member 3*a* and the inner circumferential member 3*b* such that the aluminum-based material becomes embedded in the through holes 29 and reaches the inner circumferential surface side of the inner circumferential member 3*b*.

Consequently, the through holes 29 are filled with the aluminum-based material, and thus the relative movement of the outer circumferential member 3*a* and the inner circumferential member 3*b* in the rotation direction and in the direction along the rotational axis X is prevented.

All of the advancing channels 11*a* and all of the retarding channels 11*b* penetrate through portions 30 of the outer circumferential member 3*a* that are filled in the through holes 29.

The other configurations are the same as those in the first embodiment.

Other Embodiments

1. In the valve opening/closing timing control device according to one aspect of the present invention, groove portions and elongated protruding portions that are located to intersect an advancing channel or a retarding channel may be omitted, and groove portions and elongated protruding portions that engage with each other and form a labyrinth seal portion may be dispersed to the inner circumferential surface of the outer circumferential member and the outer circumferential surface of the inner circumferential member only between every adjacent pair of an advancing channel and a retarding channel.

2. In the valve opening/closing timing control device according to one aspect of the present invention, groove portions may be alternatingly formed on the inner circumferential surface of the outer circumferential member and the outer circumferential surface of the inner circumferential member, and elongated protruding portions that engage with the groove portions that are alternatingly formed may be alternatingly formed on the inner circumferential surface of the outer circumferential member and the outer circumferential surface of the inner circumferential member.

3. In the valve opening/closing timing control device according to one aspect of the present invention, groove portions and elongated protruding portions may be provided between every adjacent pair or some adjacent pairs of an advancing channel and a retarding channel so as to extend in a direction that diagonally intersects the rotation direction.

4. In the valve opening/closing timing control device according to one aspect of the present invention, the outer circumferential member may be formed with a resin material or the like that are lighter in weight than iron-based materials, instead of the aluminum-based material.

5. In the valve opening/closing timing control device according to one aspect of the present invention, the outer circumferential member or the inner circumferential member may be configured with a forged article.

If this is the case, the axial direction groove portions may be formed by forge-processing, by which pressure is applied to the outer circumferential member or the inner circumferential member in the direction along the rotational axis.

6. The valve opening/closing timing control device according to one aspect of the present invention may be a valve opening/closing timing control device that is to be installed to various internal combustion engines other than those for automobiles.

DESCRIPTION OF REFERENCE SIGNS

1: driving rotating body
2: camshaft
3: driven rotating body
3*a*: outer circumferential member
3*b*: inner circumferential member
5: fluid pressure chamber
5*a*: advancing chamber
5*b*: retarding chamber
6: partitioning portion
7: phase control unit
11*a*: advancing channel
11*b*: retarding channel
20: inner circumferential surface of outer circumferential member
21: outer circumferential surface of inner circumferential member
23: groove portion
24: elongated protruding portion
25: protruding portion
28: columnar portion
29: through hole
30: aluminum-based material portion
E: internal combustion engine
E1: crankshaft
X: rotational axis

The invention claimed is:

1. A valve opening/closing timing control device, comprising:

a driving rotating body that rotates in synchronization with a crankshaft of an internal combustion engine;

a driven rotating body that is located on an inner circumference side of the driving rotating body coaxially with a rotational axis of the driving rotating body so as to be relatively rotatable, and that rotates in synchronization with a camshaft for opening/closing a valve of the internal combustion engine;

a fluid pressure chamber that is formed between the driving rotating body and the driven rotating body;

an advancing chamber and a retarding chamber that are formed by partitioning the fluid pressure chamber with a partitioning portion that is provided on an outer circumference side of the driven rotating body, and at least one advancing channel and at least one retarding channel that are formed to penetrate through the driven rotating body in a radial direction of the driven rotating body; and a phase control unit for controlling a rotation phase of the driven rotating body relative to the driving rotating body by supplying a pressurized fluid to the advancing chamber or the retarding chamber via the advancing channel or the retarding channel, wherein the driven rotating body has: a cylindrical outer circumferential member that is provided with the partitioning portion; and a cylindrical inner circumferential member that is located on an inside of the outer circumferential member in the radial direction, and the outer circumferential member and the inner circumferential member are formed integrally with and coaxially with each other, the advancing channel and the retarding channel are located such that a predetermined angle is formed by a center line of the advancing channel in a longitudinal direction of the advancing channel and a center line of the retarding channel in a longitudinal direction of the retarding channel, and between every pair of an advancing channel and a retarding channel, a groove portion is formed in one of an inner circumferential surface of the outer circumferential member and an outer circumferential surface of the inner circumferential member, and an elongated protruding portion is formed on the other of the inner circumferential surface of the outer circumferential member and the outer circumferential surface of the inner circumferential member at a position that corresponds to the groove portion.

2. The valve opening/closing timing control device according to claim 1, wherein the advancing channel and the retarding channel are located at different positions along a rotation direction of the driven rotating body, and the groove portion and the elongated protruding portion are provided to extend in a direction along the rotational axis.

3. The valve opening/closing timing control device according to claim 1, wherein the advancing channel and the retarding channel that are adjacent to each other are located at different positions along the rotational axis, and the groove portion and the elongated protruding portion are provided to extend along a rotation direction of the driven rotating body.

4. The valve opening/closing timing control device according to claim 2, wherein the groove portion is formed in the outer circumferential surface of the inner circumferential member, and a protruding portion is formed on the outer circumferential surface of the inner circumferential member, the protruding portion making one end portion of the groove portion more protruding than a remaining portion, and an outer circumferential portion of the inner circumferential member is enveloped in the outer circumferential member using insert casting.

5. The valve opening/closing timing control device according to claim 1, wherein the groove portion is formed by forge-processing by which pressure is applied to the outer circumferential member or the inner circumferential member in a direction along the rotational axis.

6. The valve opening/closing timing control device according to claim 1, wherein the advancing channel and the retarding channel penetrate through a bottom surface of the groove portion formed in the inner circumferential member.

7. The valve opening/closing timing control device according to claim 1, wherein the inner circumferential member is formed with an iron-based material.

8. The valve opening/closing timing control device according to claim 1, wherein the outer circumferential member is formed with a material that is lighter in weight than iron-based materials.

9. A valve opening/closing timing control device, comprising:

a driving rotating body that rotates in synchronization with a crankshaft of an internal combustion engine;

a driven rotating body that is located on an inner circumference side of the driving rotating body coaxially with a rotational axis of the driving rotating body so as to be relatively rotatable, and that rotates in synchronization with a camshaft for opening/closing a valve of the internal combustion engine;

a fluid pressure chamber that is formed between the driving rotating body and the driven rotating body;

an advancing chamber and a retarding chamber that are formed by partitioning the fluid pressure chamber with a partitioning portion that is provided on an outer circumference side of the driven rotating body, and at least one advancing channel and at least one retarding channel that are formed to penetrate through the driven rotating body in a radial direction of the driven rotating body; and a phase control unit for controlling a rotation phase of the driven rotating body relative to the driving rotating body by supplying a pressurized fluid to the advancing chamber or the retarding chamber via the advancing channel or the retarding channel, wherein the driven rotating body has: a cylindrical outer circumferential member that is provided with the partitioning portion; and a cylindrical inner circumferential member that is located on an inside of the outer circumferential member in the radial direction, and the outer circumferential member and the inner circumferential member are formed integrally with and coaxially with each other, a columnar portion that has a height that allows a front end surface thereof to be exposed from an outer circumferential surface of the outer circumferential member is formed integrally with the inner circumferential member so as to extend from an outer circumferential surface of the inner circumferential member, an outer circumferential portion of the inner circumferential member is enveloped in the outer circumferential member using insert casting, and thus the outer circumferential member and the inner circumferential member are joined together, and the advancing channel and the retarding channel extend to a surface that is flush with the front end surface of the columnar portion, and penetrate through the inner circumferential member.

10. A valve opening/closing timing control device, comprising:

a driving rotating body that rotates in synchronization with a crankshaft of an internal combustion engine;

a driven rotating body that is located on an inner circumference side of the driving rotating body coaxially with a rotational axis of the driving rotating body so as to be relatively rotatable, and that rotates in synchronization with a camshaft for opening/closing a valve of the internal combustion engine;

a fluid pressure chamber that is formed between the driving rotating body and the driven rotating body;

an advancing chamber and a retarding chamber that are formed by partitioning the fluid pressure chamber with a partitioning portion that is provided on an outer circumference side of the driven rotating body, and at least one advancing channel and at least one retarding channel that are formed to penetrate through the driven rotating body in a radial direction of the driven rotating body; and a phase control unit for controlling a rotation phase of the driven rotating body relative to the driving rotating body by supplying a pressurized fluid to the advancing chamber or the retarding chamber via the advancing channel or the retarding channel, wherein the driven rotating body has: a cylindrical outer circumferential member that is provided with the partitioning portion; and a cylindrical inner circumferential member that is located on an inside of the outer circumferential member in the radial direction, the outer circumferential member and the inner circumferential member are formed integrally with and coaxially with each other, a through hole that penetrates through the inner circumferential member in a radial direction of the driven rotating body is formed in the inner circumferential member, the outer circumferential member and the inner circumferential member are joined together by, using insert casting, enveloping an outer circumferential portion of the inner circumferential member in the outer circumferential member such that a portion of the outer circumferential member becomes embedded in the through hole, and the advancing channel and the retarding channel penetrate through the portion of the outer circumferential member that is filled in the through hole.

* * * * *